United States Patent [19]

Brunner

[11] Patent Number: 4,939,525

[45] Date of Patent: Jul. 3, 1990

[54] TUNABLE SHORT MONOPOLE TOP-LOADED ANTENNA

[75] Inventor: John E. Brunner, Hamilton, Ohio

[73] Assignee: Cincinnati Electronics Corporation, Cincinnati, Ohio

[21] Appl. No.: 177,917

[22] Filed: Mar. 31, 1988

[51] Int. Cl.[5] ..... H01Q 9/00

[52] U.S. Cl. ..... 343/745; 343/750; 343/895; 343/708

[58] Field of Search ..... 343/745, 749, 750, 752, 343/852, 825, 828, 829, 830, 831, 846, 850, 860, 895, 708

[56] References Cited

U.S. PATENT DOCUMENTS

| | | | |
|---|---|---|---|
| 3,484,787 | 12/1969 | Vallese | 343/751 |
| 3,513,473 | 5/1970 | Seward | 343/752 |
| 3,838,429 | 9/1974 | Reggia | 343/830 |
| 3,967,276 | 6/1976 | Goubau | 343/828 |
| 4,083,050 | 4/1978 | Hall | 343/729 |
| 4,101,898 | 7/1978 | Ingram | 343/895 |
| 4,104,639 | 8/1978 | Muchiarone | 343/723 |
| 4,145,693 | 3/1979 | Fenwick | 343/722 |
| 4,197,547 | 4/1980 | Czerwinski | 343/708 |
| 4,201,989 | 5/1980 | Czerwinski | 343/828 |
| 4,313,121 | 1/1982 | Campbell et al. | 343/828 |
| 4,328,501 | 5/1982 | DeSantis et al. | 343/749 |
| 4,513,290 | 4/1985 | Lefevre et al. | 343/745 |
| 4,564,843 | 1/1986 | Cooper | 343/745 |
| 4,656,483 | 4/1987 | Jaquet | 343/750 |

*Primary Examiner*—Rolf Hille
*Assistant Examiner*—Hoanganth Le
*Attorney, Agent, or Firm*—Lowe, Price, LeBlanc, Becker & Shur

[57] ABSTRACT

A short monopole RF antenna tuned over a predetermined RF frequency band in response to binary control signals includes a conductive tubular radiating element extending generally at right angles to a ground plane on which the antenna is mounted. A conductive top load inductively coupled to the element extends approximately parallel to the ground plane so that stray capacitance subsists between the ground plane and top load. The antenna is tuned in response to the control signals to a frequency in the band by selectively short-circuiting different plural series-connected inductors in proximity with the top load. Plural leads extend through the interior of the tubular element between a source of the control signals and switches for selectively short circuiting the inductors. The inductors are electrical conductors in a tube-like structure. The leads extend through the interior of the tube-like structure. Electrical conductors in the tube-like structure are in a return path to the control signal source. The switch for each inductor includes a pair of diodes positioned outside of the tube-like structure. The lead for each inductor extends through the tube-like structure and is electrically insulated from the electrical conductors. A feed for the antenna is connected to the tube at a location in proximity to the ground plane. An inductor is connected between the location where the feed is connected to the tube and the ground plane for approximately matching the feed to the tuned element for low frequencies in the RF range.

23 Claims, 2 Drawing Sheets

TUNABLE SHORT MONOPOLE TOP-LOADED ANTENNA

FIELD OF INVENTION

The present invention relates generally to top-loaded antennas employing a short monopole radiating element, and more particularly to a top-loaded antenna that is tuned by a variable inductor in proximity to the top load and controlled in response to signals connected to the variable inductor via leads extending through the radiating element. The present invention also relates to a variable inductor including plural series-connected inductors selectively short-circuited in response to control signals supplied to shorting switches for the inductors via leads extending through a tube-like structure on which are mounted electrical conductors leading and connected to the inductors.

BACKGROUND ART

Each of DeSantis et al., U.S. Pat. No. 4,328,501, and Reggia, U.S. Pat. No. 3,838,429, discloses a small, top-loaded antenna having a top load formed as a metal conducting plate extending generally parallel to a ground plane through which a monopole radiating element extends. In each instance, the top load is capacitively coupled to the monopole radiating element.

In the DeSantis et al. antenna, a center conductor of a coaxial cable extending through the radiating element is electrically connected to the top load by an inductor shunted by a resistor. The network including the shunt resistor and inductor makes the antenna broadband but lossy. The DeSantis et al. antenna thus has low radiation efficiency, requiring relatively high amplitude sources to drive the antenna for long range applications. Since short antennas are generally used on mobile structures having limited power, such as aircraft, the low efficiency DeSantis et al. antenna is not suitable for long range applications.

The Reggia antenna is characterized as including a spiral as part of the top load for a short vertical monopole radiator. The spiral functions as an open circuit transmission line. Currents in two sides of the transmission line are oppositely directed, tending to cancel the effect of each other in a distant field of the antenna. Thereby, only the short vertical monopole radiator contributes to the distant field radiation. However, the printed circuit spiral is a narrow band device capable of being varied only by movement of a mechanical element, such as probe transversing the spiral. Hence, the Reggia structure cannot be rapidly tuned over a wide bandwidth and operate with high efficiency.

One type of variable inductor that has been used for tuning includes plural series-connected inductive elements having values related to each other in a binary manner, such that, for example, the values of the inductive elements are L, L/2, L/4, L/8, L/16, L/32, etc. Different ones of the inductive elements are selectively short-circuited, to control the value of the inductor. Short-circuiting is accomplished in response to a binary signal having multiple bits, one of which is provided for each of the inductive elements. Each inductive element is short-circuited by connecting opposite terminals of the particular element to a pair of PIN diodes having like electrodes connected to each other and to a binary bit source controlling forward and reverse biasing of the diodes. A source for each binary bit is connected to the diodes associated with the particular inductive element via a separate radio frequency choke, designed so that RF currents flowing through the inductive elements are decoupled from the binary bit source. A return path to the binary bit sources is provided by a further RF choke.

A problem with this prior art variable inductor is that multiple RF chokes are selectively connected in parallel between the several inductive elements and several of the binary bit sources. The parallel connections of the RF chokes have a tendency to draw RF current from the inductor and thereby to affect adversely the performance of the inductor for RF purposes. As the number of bits in a binary inductor bank increases, loading by the RF chokes becomes an increasing problem tending to degrade the quality factor (Q) and alter the value of the individual inductors comprising the bank, causing deviation from the desired binary relationship. Hence, there are disadvantages in tuning the prior art short monopole radiating elements utilizing conventional controllers for the value of a variable inductor.

It is, accordingly, an object of the present invention to provide a new and improved structure for rapidly tuning an efficient short, top-loaded monopole antenna over a relatively wide frequency range.

Another object of the invention is to provide a new and improved variable inductor, particularly adapted for use in connection with efficient, tunable, short, top-loaded monopole antennas.

Still another object of the invention is to provide a new and improved variable inductor including plural series-connected inductive elements selectively short-circuited in response to control signals coupled to the inductive elements in such a manner as to minimize interference with the performance of the inductor in handling RF currents.

Another object of the present invention is to provide a new and improved RF inductor controlled by a binary bit control source so that RF currents flowing through the inductor do not interact with the control source, so the inductor has a high Q, repeatability in changes of inductive value and can operate over a wide frequency band in a uniform manner.

THE INVENTION

In accordance with one aspect of the invention, an RF antenna that is tunable in response to control signals over a predetermined frequency band, adapted to be mounted on a ground plane and to be connected in substantially matched relation to an RF feed comprises a conductive tubular monopole radiating element extending generally at right angles to the ground plane. The radiating element is short having a length no greater than approximately 1/25 of a wavelength of the lowest frequency in the frequency band. A conductive top load plate inductively coupled to the top of the monopole radiating element extends approximately parallel to and is spaced by about the length of the monopole from the ground plane. Thereby, stray capacitance subsists between the ground plane and top load.

The antenna includes means responsive to the control signals for tuning the antenna and the stray capacitance to a frequency in the band. The tuning means includes plural series inductors $L_1 \ldots L_n$, in proximity with the load. An end of inductor $L_n$ is electrically connected to the top load. Voltage controlled switch means responsive to the control signals selectively short-circuit inductors $L_1 \ldots L_n$. Plural control leads extend through the interior of the tubular element between a source of the control signals and the switch means.

Because the control leads extend through the interior of the tubular base inductor and monopole radiating element, the control signals and control leads do not interfere with RF currents on the external surface of the monopole or base inductor. Therefore, the RF impedance and radiation properties of the radiating structure are not altered by the presence of the control leads. Conversely, RF currents on the radiating structure do not couple to the control leads and do not affect control of the inductor bank.

To obviate the need for plural parallel chokes, one for each of the binary bits that control the switch means for inductive elements of the variable inductor, the switched inductors are preferably formed as electrical conductors having a tube-like structure. The leads carrying the control signals extend through the interior of the tube-like structure. The electrical conductors forming the inductors are in a return path to a source of the control signal. A lead for inductor $L_k$ (where k is selectively each of 1 . . . n) is connected to like electrodes of first and second diodes, the other electrodes of which are connected to opposite terminals of inductive element $L_k$. The first and second diodes are positioned outside of the tube-like structure so that the lead for inductor $L_k$ extends through the tube-like structure and is electrically insulated from the electrical conductors of the tube-like structure. In a preferred embodiment, the tube-like structure is a braided sheath of the type employed as the outer conductor of a flexible coaxial cable.

To assist in achieving impedance matching between the antenna and a feed for the antenna, a fixed inductor is connected between the bottom of the conductive element functioning as the monopole radiator and the ground plane. This inductor is also formed from a hollow tube-like structure with control lines extending through and insulated from the interior of the tube-like structure. At lower frequencies in the band, the inductor between the monopole and the ground plane functions as an impedance transformer between the feed and the monopole radiating element. At higher frequencies in the band, where all of the inductors in proximity to the top load are effectively short-circuited, the fixed inductor between the monopole and ground plane functions as a choke having virtually an infinite impedance. At these frequencies, the radiating element impedance is adequately matched to the feed. For one use of the present invention, adequate matching occurs for voltage standing wave ratios (VSWR's) of less than 2.5 to 1.

The present high efficiency antenna is ideally suited to be rapidly tuned over a wide bandwidth, consistent with modern frequency hopping transceivers. The short height of the antenna, resulting from its short radiating element, makes it ideally suited for vehicular, particularly aircraft, mounting.

The above and still further objects, features and advantages of the present invention will become apparent upon consideration of the following detailed description of a specific embodiment thereof, especially when taken in conjunction with the accompanying drawings.

DETAILED DESCRIPTION OF THE PREFERRED EMBODIMENT

Figure 1:
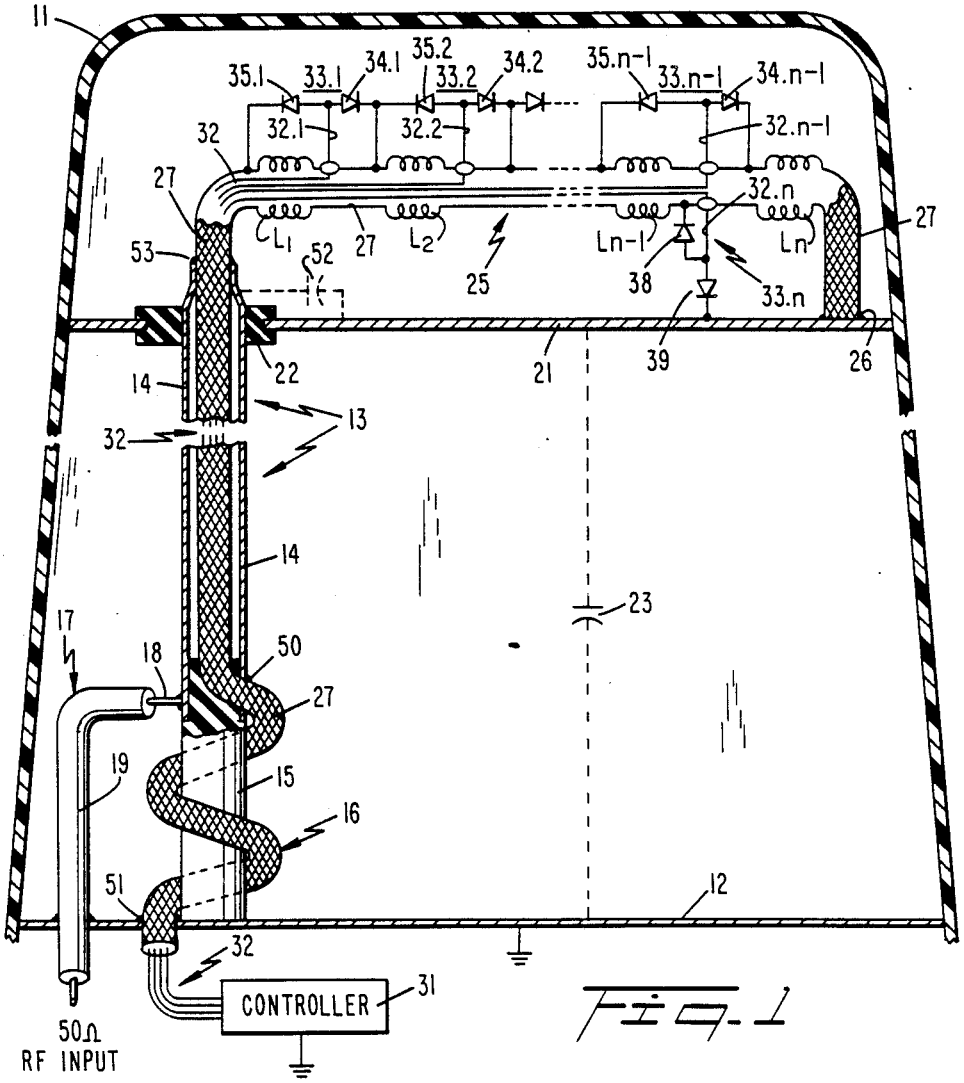
FIG. 1 is a schematic diagram of a preferred embodiment of the present invention as included in an aircraft antenna.

Reference is now made to FIG. 1 of the drawing wherein a preferred embodiment of the invention is illustrated as an aircraft antenna operating in the high frequency and low portion of the very high frequency ranges, i.e., approximately between 30 MHz and 150 MHz. The antenna is illustrated as being housed in dielectric radome 11 mounted on a metal aircraft fuselage 12, which functions as the antenna ground plane.

The antenna includes an electrically short radiating element 13 extending at right angles to ground plane 12 so the radiating element is insulated from the ground plane. Radiating element 13 is a metal, electrically conductive tube 14 mounted on dielectric cylindrical stub shaft 15, in turn mounted on ground plane 12. Fixed inductor or choke 16, formed by winding tube like braided sheath 27 on dielectric shaft 15, is electrically connected between the bottom of metal tube 14 and ground plane 12, to provide (a) a virtually infinite impedance for high frequency (greater than about 100 MHz) signals transduced by antenna 10, (b) impedance matching for lower frequencies (between about 30 MHz and 100 MHz), and (c) a DC short circuit between tube 14 and ground plane 12. In a preferred embodiment, inductor 16 is a single turn wound on a $\frac{1}{8}$ inch diameter dielectric shaft.

Coaxial cable RF feed 17 is connected between the bottom of metal tube 14 and ground plane 12, to couple an RF signal between radiator 13 and a transmitter, receiver or transceiver in the aircraft of which the ground plane fuselage 12 is a part. The coaxial cable of feed 17 includes center conductor 18, having a first end connected to tube 14 at its intersection with coil 16, and a second end connected to the transmitter, receiver or transceiver. The coaxial cable includes an outer grounded sheath connected to ground plane 12.

Mounted on tube 14 is metallic, electrically conductive top load plate 21. Plate 21 is positioned at right angles to tube 14, so the plate is parallel to ground plane 12. Top load plate 21 is positioned relative to tube 14 by dielectric washer 22, having a groove into which the top load plate is seated. Washer 22 has an inner circumference fixedly secured to the exterior of tube 14. Spacing between top load plate 21 and tube 14, at washer 22, is as large as practically feasible to minimize stray capacity 52. Washer 22 is made of a low permittivity dielectric material to further minimize capacity 52. Reduction of stray capacity 52 results in a higher quality factor (Q) for the variable top load inductor 25 yielding improved overall radiation efficiency. Parasitic or stray capacitance, represented by stray capacitor 23, subsists between top load plate 21 and ground plane 12.

Capacitance 23 is effectively in series with variable top load inductor 25, in turn connected to top load plate 21 at one end via solder joint 26 and tube 14 of radiator 13 at the opposite end via solder joint 53. Resonating the reactance of stray capacitance 23 with variable inductor 25 results in a virtual short circuit between the top end of radiator 13 and ground plane 12. The virtual short circuit results in a large RF current at the top of radiator 13 when RF is applied by feed 17 at the base of radiator 13. Since radiator 13 is short in terms of a wavelength, typically 1/25 of a wavelength at the lowest frequency of operation, the RF current at the base of radiator 13 is very nearly equal to the RF current at the top of radiator 13. In other words, the magnitude of RF current flowing on the exterior surface of radiator 13 is substantially constant over the full length of the radiator. This results in a radiation resistance nearly four times greater than that obtained from a radiator of the same height but without top loading. Thereby, radiation efficiency of the composite antenna is significantly improved relative to the same height radiator without top loading.

Alternately, near uniform current over the length of radiator 13 can be achieved without inductor 25 by making stray capacitance 23 very large. This requires a significant increase in the surface area or size of top load plate 21, which in this configuration would be directly connected to the top of radiator 13. However, a large top load plate is undesirable if aerodynamic drag and associated mechanical stresses need be considered. Moreover, if capacitance 23 has a large value the antenna impedance characteristics are degraded at higher frequencies. Introduction of variable inductor 25, at the top of the antenna, allows the top load impedance to be effectively varied as a function of applied frequency.

The antenna impedance seen by feed 17 at its connection to radiator 13 (feed point), is the series combination of stray capacitance 23 and variable inductor 25 transformed to the feed point, plus the radiation resistance of monopole radiator 13. The antenna is impedance matched to a transceiver connected to feed 17 by tuning variable inductor 25 such that the series combination of inductor 25 and capacitance 23 results in a conductance at the feed point equal to the characteristic admittance (typically 20 millimohs corresponding to 50 ohms) of feed 17. At the lower operating frequencies, the desired admittance at the feed point is accompanied by a large capacitive susceptance which is tuned out by inductor 16, yielding a resistance equal to the characteristic impedance of feed line 17. As frequency of the RF device connected to feed 17 increases, variable inductor 25 is tuned to maintain the desired conductance at the feed point; this is accompanied by decreasing capacitive susceptance at the feed point. The decrease in susceptance at the feed point is caused by increasing electrical length and associated radiation resistance of monopole radiator 13. Inductive susceptance, provided by fixed inductor 16, also decreases with increasing frequency. In the preferred embodiment of the invention, the feed point capacitive susceptance variation is very nearly tracked (over 30–100 MHz) by the varying inductive susceptance of fixed inductor 16. Thereby, an acceptable impedance match (VSWR=2.5) is maintained over a 30–100 MHz frequency range by tuning only inductor 25.

The value of inductor 25 is controlled in response to a multibit digital signal supplied by multiple lead bus 32 extending through braided shield conductor 27 and tube 14 to the inductor. The value of the bits controlling the value of inductor 25 is changed as the frequency of the device connected to feed 17 varies and/or as the reactance of capacitor 23 changes to equalize the reactive impedances of the inductor and capacitor 23 at the operating frequency of the RF device connected to feed 17.

In one embodiment of the invention which was actually constructed, variable inductor 25 includes a metal braided sheath of the type used for the outer, shield conductor of a coaxial cable. Multiple insulated conductors, one for each control bit, pass through the interior of the braided sheath to form a multiconductor shielded cable. The shielded cable is wound as a helix on cylindrical dielectric coil form 40 such that the sheath forms a series connected set off binary related RF inductors ($L_1$, $L_2$ ---- $L_n$) located above plate 21 so the axis of the cylindrical coil form 40 is parallel to plate 21. The pitch of the helix is generally the same for each of inductors $L_1$, $L_2$ --- $L_n$ but the number of turns in different ones of the inductors differs. However, the pitch of the helix between adjacent inductors differs from the pitch within the inductors whereby adjacent pairs of individual inductors $L_1$, $L_2$ ---- $L_n$ are spaced from each other along the length of coil form 40. This minimizes mutual coupling between the several inductors so that the inductors are independently and separately controlled. One end of sheath 27, forming the series inductor set, is connected to tube 14 via solder joint 53, while the other sheath end is connected by solder joint 26 to the end of plate 21 remote from dielectric spacer 22. Sheath 27 extends downward through the interior of tube 14 and is brought out through a hole in the wall of tube 14 at the point where tube 14 mates with dielectric post 15. Sheath 27 is wound on post 15 to form RF inductor 16. Sheath 27 is connected to the lower end of tube 14 by solder joint 50 and extends through and is connected to ground plane 12 by solder joint 51.

To vary the value of inductor 25, digital control source 31 is included in the aircraft of which radome 11 is a part. Control source 31 is a multibit, parallel source for simultaneously deriving n digital bits, where n is an integer greater than one and equal to the number of individual inductor elements $L_1 \ldots L_n$ in variable inductor 25. As such, source 31 includes n signal output terminals on which are derived the n bits, as well as a ground terminal connected to ground plane 12. Connected to the n output terminals of source 31 are n insulated leads forming control bus 32 for coupling signals to inductor 25, to control the value of the inductor.

Figure 2:
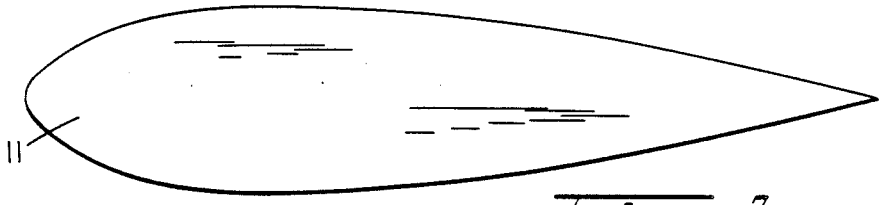
FIG. 2 is a top view of an antenna housing for the structure illustrated in FIG. 1.
Figure 3:
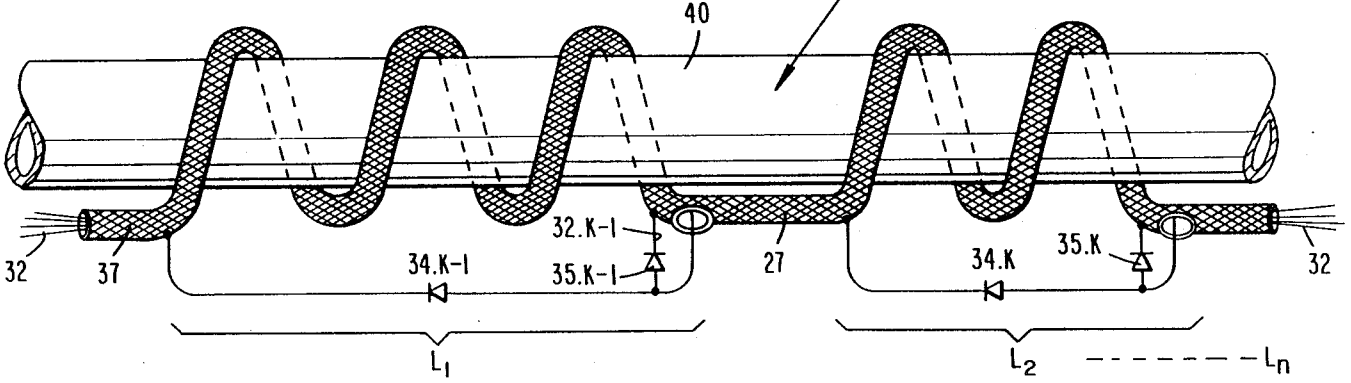
FIG. 3 is a perspective, cutaway view of a preferred configuration of the variable inductor of FIG. 1.

As illustrated in FIGS. 1,2 and 3, the insulated leads of bus 32 extend through the interiors of tube 14 and sheath 27. Different ones of the leads in bus 32 protrude through sheath 27 at different points along the length of the sheath and are connected to different diode switches 34, connected to different points along the length of the sheath. In response to the binary bits on the leads in bus 32 different ones of diode switches 33 are selectively open and short circuited, to control the value of inductor 25.

Diode switch 33.1, at the first position along the length of sheath 27, includes PIN diodes 34.1 and 35.1, having anodes connected to lead 32.1 of bus 32. Diodes 34.1 and 35.1 include cathodes, respectively connected to sheath 27 at the point where insulated lead 32.1 extends through sheath 27 and where sheath 27 is initially connected to tube 14. In response to a positive, binary one voltage level being applied to lead 32.1 by source 31, diodes 34.1 and 35.1 are forward biased to effectively short circuit the length of sheath 27 between the points along the sheath where the cathodes of diodes 34.1 and 35.1 are connected. A return path for the signal supplied by lead 32.1 to diodes 34.1 and 35.1 is provided through sheath 27, tube 14 and inductor 16 and ground plane 12 back to the ground terminal of source 31. In response to a binary zero (negative voltage) being applied to lead 32.1, diodes 34.1 and 35.1 are reverse biased so the length of sheath 27 between the points along the sheath where the cathodes of diodes 34.1 and 35.1 are connected is in series between tube 14 and top load 12. Hence, in response to binary zero and one levels being applied to lead 32.1 by source 31, the inductance ($L_1$) of sheath 27 between the points along the sheath connected between the cathodes of diodes 34.1 and 35.1 is effectively inserted into and removed from the resonant circuit. Typically, the inductance along the length of sheath 27 between the points to which the cathodes of diodes 34 and 35 are connected has a value $L_1=L_T/2$, where $L_T$=the maximum total inductance of sheath 27 between the point to which the cathode of diode 35 is connected to the sheath and the end of the sheath connected to plate 21 by solder joint 26.

Control for the next segment ($L_2$) of inductor 25 is provided by a binary signal applied to insulated lead 32.2 of bus 32 and by diodes 34.2 and 35.2. The anodes of diodes 34.2 and 35.2 are connected to lead 32.2 which extends through sheath 27 at a point between the point where insulated lead 32.1 extends through the sheath and the end of the sheath connected to solder joint 26. Diodes 34.2 and 35.2 have anodes respectively connected to the points on sheath 27 where leads 32.2 and 32.1 extend through the sheath. The connection points along sheath 27 for the anodes of diodes 34.2 and 35.2 are selected such that an inductance $L_2=L_T/4$ subsists between them. The remaining diode switches 33.3 . . . 33.n−1 for inductance segments $L_3 \ldots L_{n-1}$ are constructed identically to diode switches 33.1 and 33.2, with the inductance along the length of the sheath for inductor $L_k$ being equal to $2^{-k}L_T$ where, k is selectively every integer from 1 to n−1.

In FIG. 3 is illustrated inductor element $L_k$, between insulated leads 32.k−1 and 32.k. Element $L_k$ is controlled by diodes 34.k and 35.k having anodes connected to insulated lead 32.k that extends through and is insulated from sheath 27. The cathode of diode 35.k is soldered to sheath 27 approximately at the same place as where lead 32.k extends through the sheath. The anode of diode 34.k is soldered to sheath 27 approximately at the same place as where insulated lead 32.k−1 extends through the sheath. Similar connections subsist for the remaining diode switches, as partially illustrated in FIG. 3 by diodes 34.k+1, 34.k−1 and 35.k−1.

Diode switch 33.n for the last segment of sheath 27, which is responsive to the signal applied to lead 32.n, differs somewhat from the remaining diode switches 33.1 . . . 33.(n−1). Switch 33.n includes diodes 38 and 39, having anodes connected to lead 32.n at the point where lead 32.n extends through sheath 27. Diodes 38 and 39 include cathodes respectively connected to plate 21 and to a point on the sheath immediately adjacent the region where lead 32.n extends through the sheath. In response to binary one, positive voltage and binary zero, negative voltage levels being applied to lead 32.n, diodes 38 and 39 are respectively forward and back biased. In response to diodes 38 and 39 being forward biased, the length of sheath 27 between the connection of the anode of diode 39 and the end of the sheath connected to plate 21 by solder joint 26 is short circuited. Sheath 27 has an inductance $L_n=2^{-n}L_T$ between the point on the sheath to which the anode of diode 39 is connected and the end of the sheath connected by solder joint 26 to plate 21. In response to binary one and zero values being applied to lead 32.n by source 31, the inductance of sheath 27 having the lowest discrete magnitude, $L_n$, is selectively removed from and inserted into the series resonant circuit with capacitor 23.

Lead 32.(n−1) for control of the inductance of sheath 27 having the second lowest resolution value, $L_{n-1}=2^{-(n-1)}L_T$ is inserted through sheath 27 at the same point as lead 32.n. The anode of diode 34.(n−1) is connected to sheath 27 at substantially the same place as where leads 32.(n−1) and 32.n protrude through the sheath. The anode of diode 35.(n−1) is connected to sheath 27 at a suitable position along the length of the sheath between the point where leads 32.(n−1) and 32.n extend through the sheath and the end of the sheath connected to tube 14 to provide an inductance along the length of the sheath equal to $L_{n-1}$.

Radiator 13 is primarily capacitive at the low end (30 MHz–70 MHz) of the band of frequencies associated with feed 17, is resistive in the middle portion (70 MHz–100 MHz) of the band, and inductive at the high end (100 MHz–150 MHz) of the band. At the high end of the band, radiator 13 is sufficiently inductive that it is tuned by parasitic capacitor 23, without need for variable inductor 25. In a particular embodiment of the invention actually constructed, the value of inductor 25 is set to zero for frequencies between 100 and 150 MHz, with tuning being provided exclusively by the inductance of radiator 13 and parasitic capacitor 23. To provide tuning over the band between 30 and 100 MHz, the value of inductor 25 is varied in response to binary signals from control source 31 applied to PIN diodes 34 and 35 by leads 32.

Locating inductor 25 above top load plate 21, such that stray capacitance 23 can be very nearly resonated, effectively increases the electrical size of the physically small top load plate resulting in near uniform RF current over the full length of radiating element 13, thereby increasing radiation resistance and associated radiation efficiency of the antenna. Also, by locating leads 32 inside sheath 27 and tube 14 the RF properties of radiator 13 are not disturbed. Because of skin effect all of the RF current flowing in sheath 27 and radiator 13 is on the outer periphery thereof so there is complete isolation between the control signals and the antenna RF circuit. It is important to isolate the control signals from the RF antenna circuit to provide the electrically small antenna with high radiation efficiency. Any dissipative loss or stray reactances introduced by the control, i.e., tuning, circuitry degrades radiation efficiency and may introduce tuning anomalies.

While there has been described and illustrated one specific embodiment of the invention, it will be clear that variations in the details of the embodiment specifically illustrated and described may be made without departing from the true spirit and scope of the invention as defined in the appended claims.

What is claimed:

1. An RF antenna tunable in response to a control signal over a predetermined frequency band having a minimum frequency with a predetermined wavelength, said antenna to be mounted on a ground plane and to be connected to an RF feed, the antenna comprising a metal tubular radiating element extending generally at right angles to the ground plane, the radiating element having an electrically short length relative to the predetermined wavelength, a metal top load electrically coupled to the radiating element extending approximately parallel to and spaced by about the length of the radiating element from the ground plane, the radiating element extending between the top load and the ground plane, stray capacitance being between the ground plane and top load, and means responsive to the control signal for tuning the antenna and the stray capacitance to a frequency in the predetermined frequency band, said tuning means including plural series connected inductors $L_1 \ldots L_n$ in proximity with the top load, means for electrically connecting an end of inductor $L_1$ to the radiating element and an end of inductor $L_n$ to the top load, voltage controlled switch means responsive to the control signal for selectively connecting different ones of inductors $L_1 \ldots L_n$ in circuit with the radiating element and top load, and plural leads extending through the interior of the tubular element between a source of the control signal and the switch means for supplying the control signal to the switch means to control the value of inductance between the top load and radiating element.

2. The RF antenna of claim 1 wherein the inductors are formed of a metal tube-like structure, the leads extending through the interior of the metal tube-like structure, the leads being electrically insulated from the metal tube-like structure, the metal tube-like structure being in a return path to a source of the control signal.

3. The RF antenna of claim 2 wherein one of said leads is provided for inductor $L_k$, the switch means for inductor $L_k$ including first and second diodes having like electrodes connected to one end of the lead for inductor $L_k$, where k is selectively each of 1 . . . n, other electrodes of the first and second diodes being respectively connected to opposite terminals of inductor $L_k$.

4. The RF antenna of claim 3 wherein the first and second diodes are positioned outside of the tube-like structure, the lead for inductor $L_k$ extending through the tube-like structure and being electrically insulated from the electrical conductors of the tube-like structure.

5. The RF antenna of claim 4 wherein the tube-like structure is a braided sheath.

6. The RF antenna of claim 2 wherein the metal tube-like structure is wound as a helix, the pitch of the helix between inductors; $L_k$ and $L_{k+1}$ being less than the pitch of the helix of inductors $L_k$ and $L_{k+1}$ to minimize inductive coupling between inductors $L_k$ and $L_{k+1}$.

7. The RF antenna of claim 1 wherein the feed is connected to the tubular radiating element at a location in proximity to the ground plane, an inductor connected between said location and the ground plane for approximately matching the feed to the tubular radiating element at the low end of the predetermined frequency band, the leads extending through the inductor.

8. The antenna of claim 1 wherein said leads extend through the top load, all of the inductors and switch means being mounted above the top load.

9. The antenna of claim 1 wherein said inductors $L_1 \ldots L_n$ are selectively short circuited in response to the control signal supplied by the leads to the switch.

10. A variable inductor responsive to a control signal comprising plural series inductors $L_1 \ldots L_n$, voltage controlled switch means responsive to the control signal for selectively short circuiting different ones of inductors $L_1 \ldots L_n$, inductors $L_1 \ldots L_n$ being formed of a metal tube-like structure, and plural leads extending through the tube-like structure between a source of the control signal and the switch means for supplying the control signal to the switch means to control the value of the inductor, the metal tube-like structure being in a return path to a source of the control signal, one of said leads being provided for inductor $L_k$, the switch means for inductor $L_k$ including first and second diodes having like electrodes connected to one end of the lead for inductor $L_k$, where k is selectively each of 1 . . . n, other electrodes of the first and second diodes being respectively connected to opposite terminals of inductors $L_k$.

11. The inductor of claim 8 wherein the first and second diodes are positioned outside of the metal tube-like structure, the lead for inductor $L_k$ extending through the tube-like structure and being electrically insulated from the metal tube-like structure.

12. A variable inductor responsive to a control signal comprising plural series inductors $L_1 \ldots L_n$, voltage controlled switch means responsive to the control signal for selectively short circuiting different ones of inductors $L_1 \ldots L_n$, inductors $L_1 \ldots L_n$ being formed of a metal tube-like structure, and plural leads extending through the tube-like structure between a source of the control signal and the switch means for supplying the control signal to the switch means to control the value of the inductor, the metal tube-like structure being in a return path to a source of the control signal, the metal tube-like structure being wound as helix, the pitch of the helix between inductors $L_k$ and $L_{k+1}$ being less than the pitch of the helix of inductors $L_k$ or $L_{k+1}$ to decrease inductive coupling between inductors $L_k$ and $L_{k+1}$.

13. The inductor of claim 12 wherein one of said leads is provided for inductor $L_k$, the switch means for inductor $L_k$ including first and second diodes having like electrodes connected to one end of the lead for inductor $L_k$, where k is selectively each of 1 . . . n, other electrodes of the first and second diodes being respectively connected to opposite terminals of inductor $L_k$.

14. The inductor of claim 13 wherein the first and second diodes are positioned outside of the metal tube-like structure, the lead for inductor $L_k$ extending through the tube-like structure and being electrically insulated from the metal tube-like structure.

15. An antenna for multiple frequencies in a predetermined frequency range comprising a hollow, substantially vertically extending metal radiating element having a length between bottom and top ends thereof no greater than about 1/25 of a wavelength of the shortest wavelength of the multiple frequencies, a coil electrically connected between the bottom end and a substantially horizontally extending ground plane in proximity to the bottom end, the coil providing a matching impedance for at least some frequencies in the band between a feed for the antenna and the antenna, a substantially horizontally extending metal top load in proximity to the top end coupled to the radiating element by a tuning inductor connected between the radiating element and the top load, the radiating element extending between the ground plane and the top load, stray capacitance being between the top load and the ground plane, means for varying the value of the tuning inductor so that the inductive and capacitive impedances of the antenna and reactances coupled to the antenna are approximately equal at each of the multiple frequencies, the tuning inductor including multiple inductor elements, means for selectively connecting different ones of the multiple inductor elements in circuit with the top load and radiating element, each of the inductor elements including metal tube means having an inductive reactance at frequencies in the frequency range, the means for varying including multiple leads extending through the radiating element, the tube means and the coil, each lead being coupled to the means for selectively connecting and carrying a signal for controlling the means for selectively connecting to control the value of inductance of the tuning inductor.

16. The antenna of claim 15 wherein the top load is inductively coupled to the top end.

17. The antenna of claim 15 wherein the tube means comprises a braided sheath.

18. The antenna of claim 15 wherein the tube-like structure is wound as a helix, the pitch of the helix between inductors $L_k$ and $L_{k+1}$ being less than the pitch of the helix of inductor $L_k$ and $L_{k+1}$ to minimize inductive coupling between inductors $L_k$ and $L_{k+1}$.

19. The antenna of claim 15 wherein the feed is connected to the bottom end of the radiating element.

20. The antenna of claim 13 wherein the means for varying includes a pair of diodes for each of the inductor elements, each pair of diodes having like electrodes connected to an end of one of the leads, other electrodes of each pair of diodes being connected to opposite terminals of the inductor element associated with the particular pair of diodes.

21. The antenna of claim 20 wherein said diodes are located outside of the tube means, and said end of each of the leads extends through the tube means.

22. The antenna of claim 15 wherein said leads extend through the top load, all of the inductor elements being mounted above the top load.

23. An RF antenna system comprising an RF feed, a ground plane, a multi-bit digital control source, an RF antenna tunable over a predetermined frequency band having a minimum frequency with a predetermined wavelength, said antenna including:

a hollow metal radiating element extending generally at right angles to the ground plane having an electrically short length relative to the predetermined wavelength, a metal top load electrically coupled to the radiating element extending approximately parallel to and spaced by about the length of the radiating element from the ground plane, the radiating element extending between the top load and the ground plane, stray capacitance being between the ground plane and top load, and means connected to be responsive to the control signal source for tuning the antenna and the stray capacitance to a frequency in the predetermined frequency band, said tuning means including plural series connected inductors $L_1 \ldots L_n$ in proximity with the top load, means for electrically connecting an end of inductor $L_1$ to the radiating element and an end of inductor $L_n$ to the top load, voltage controlled switch means connected to be responsive to the control signal source for selectively connecting different ones of inductors $L_1 \ldots L_n$ in circuit with the radiating element and top load, and plural leads extending through the interior of the tubular element between the control signal source and the switch means for supplying the control signal to the switch means to control the value of inductance between the top load and radiating element.

* * * * *